US006484399B2

(12) United States Patent
Aono et al.

(10) Patent No.: US 6,484,399 B2
(45) **Date of Patent: *Nov. 26, 2002**

(54) METHOD FOR PRODUCING INK JET RECORDING HEAD, AND INK JET RECORDING HEAD PRODUCED BY THE SAME METHOD

(75) Inventors: Kenji Aono, Kawasaki; Akihiko Shimomura, Yokohama, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/201,793

(22) Filed: Dec. 1, 1998

(65) Prior Publication Data

US 2002/0001016 A1 Jan. 3, 2002

(30) Foreign Application Priority Data

Dec. 1, 1997 (JP) ..... 9-330290

(51) Int. Cl.[7] ..... B21D 53/76; G03C 5/00

(52) U.S. Cl. ..... 29/890.1; 29/611; 430/320; 430/394; 430/311; 427/492; 427/510; 347/45; 347/47

(58) Field of Search ..... 29/611, 890.1, 29/25.35; 216/27, 34, 56; 427/492, 508, 510, 512; 347/44, 45, 47; 430/320, 394, 311

(56) References Cited

U.S. PATENT DOCUMENTS 4,454,519 A * 6/1984 Oosaka et al. ..... 347/45
5,023,026 A * 6/1991 Yoshida et al. ..... 427/508
5,296,273 A * 3/1994 Abe et al. ..... 427/508
5,312,517 A * 5/1994 Ouki ..... 427/508
5,451,992 A 9/1995 Shimomura et al. ..... 347/45
5,598,193 A * 1/1997 Halko et al. ..... 347/45
5,633,664 A * 5/1997 Bayat ..... 427/510
5,716,740 A * 2/1998 Shiba et al. ..... 427/492
5,932,299 A * 8/1999 Katoot ..... 427/512

FOREIGN PATENT DOCUMENTS

EP 2283208 * 12/1993 ..... 347/45
JP 57-105359 * 6/1982 ..... 430/320
JP 5-330060 * 12/1993 ..... 427/508

OTHER PUBLICATIONS

Method to Etch Panels with Plated through Holes by using Ink Jet Nozzles, IBM Technical Disclosure Bulletin, vol. 28, No. 7, p. 3042, Dec. 1985.*

Biederman et al, Deposition and properties of hydrophilic films prepared by plasma polymerization of Ar/n–hexane/H20, Vacuum, vol. 26, No. 12, pp. 1413–1418, Dec. 1995.*

* cited by examiner

*Primary Examiner*—Peter Vo
*Assistant Examiner*—A. Dexter Tugbang
(74) *Attorney, Agent, or Firm*—Fitzpatrick, Cella, Harper & Scinto

(57) ABSTRACT

A method for producing an ink jet recording head comprising the following steps, a step which forms the photosensitive water-repellent processing layer in the ink discharge port face, a step which irradiates light onto the water-repellent forming region and hydrophilic forming region in the water-repellent processing layer, to cure the layer, a step which irradiates light selectively onto the hydrophilic forming region to reduce water repellency of the water-repellent processing layer and to impart hydrophilicity to the hydrophilic forming region, and a step which forms an opening, which constitutes part of the ink discharge port, in the water-repellent processing layer.

12 Claims, 2 Drawing Sheets

METHOD FOR PRODUCING INK JET RECORDING HEAD, AND INK JET RECORDING HEAD PRODUCED BY THE SAME METHOD

BACKGROUND OF THE INVENTION

1. Field of the Invention

This invention relates to an ink jet recording head, which effects recording with fine droplets of a recording solution, generally known as ink, discharged from a fine port and ejected onto a record face to be attached thereto, and more particularly to a method for producing an ink jet recording head finished so as to be water-repellent in such a way to have a hydrophilic section around the ink discharge port, and to an ink jet recording head produced by the same method.

2. Related Background Art

An ink jet recording head is generally equipped with a fine ink discharge port, liquid passage, and discharge energy generating section provided in part of the liquid passage. It is known that discharge stability is generally enhanced by making the head water-repellent around the ink discharge port.

However, printing quality is sometimes degraded, when an ink discharge port is finished so as to be water-repellent at its face front. It is found that this phenomenon results from poor discharge caused by that when a large quantity of ink is present on the ink discharge port face, it moves to the discharge port.

Therefore, the face that is finished so as to be water-repellent is partly provided with a hydrophilic section, which holds ink to prevent its migration.

Such a hydrophilic section is formed by various methods, e.g., laser ablation in which a water-repellent processed layer formed is partly irradiated with laser beams to remove the part, and another method known as photolithography process in which a water-repellent light-sensitive resin layer, formed on the ink discharge port face, is selectively exposed to light and developed.

The above methods to form the hydrophilic section involve the following problems;

(1) an expensive irradiation is needed, (2) another step is needed for the water-repellent finishing, needing a changeover of setup, (3) adjustment of the irradiation is complicated, or (4) irregularities are formed on the ink discharge port surface, possibly holding waste in the cavities to cause wiping problems.

SUMMARY OF THE INVENTION

The present invention is made in view of the above problems. It is an object of the present invention to provide a method for producing an ink jet recording head, which is free from the above problems, produced by an inexpensive system, and excellent in discharge stability. It is another object of the present invention to provide an ink jet recording head produced by the same method.

The above problems can be solved, and the objects can be achieved by the present invention described in detail below.

The present invention provides a method for producing an ink jet recording head equipped with an ink discharge port from which the ink is discharged, an ink discharge port face on which the ink discharge port is set and an discharge energy generating element which generates energy necessary to discharge the ink, and is finished so as to be water-repellent in such a way to make the ink discharge port face partly hydrophilic around the ink discharge port, comprising the following steps:

a step which forms the photosensitive water-repellent processing layer on the ink discharge port face, a step which irradiates light onto the water-repellent forming region and hydrophilic forming region in the water-repellent processing layer, to cure the layer, a step which further irradiates light selectively onto the hydrophilic forming region to reduce water repellency of the water-repellent processing layer and to impart hydrophilicity to the hydrophilic forming region, and a step which forms an opening, which constitutes a part of the ink discharge port, in the water-repellent processing layer.

The present invention also provides the ink jet recording head produced by the above method.

The present invention also provides a method for producing an ink jet recording head equipped with an ink discharge port from which the ink is discharged, an ink discharge port face on which the ink discharge port is set and a discharge energy generating element which generates energy necessary to discharge the ink, and is finished so as to be water-repellent in such a way to make the ink discharge port face partly hydrophilic around the ink discharge port, comprising the following steps:

a step which forms the photosensitive water-repellent processing layer on the ink discharge port face, a step which irradiates light onto the water-repellent forming region in the water-repellent processing layer, to cure the layer, a step which irradiates light in a quantity in excess of the level required for curing the water-repellent processing layer onto the hydrophilic forming region to reduce the water repellency of the water-repellent processing layer and to impart hydrophilicity to the hydrophilic forming region, and a step which forms an opening, which constitutes a part of the ink discharge port, in the water-repellent processing layer.

The present invention also provides the ink jet recording head produced by the above method.

DETAILED DESCRIPTION OF THE PREFERRED EMBODIMENTS

The present invention is described more concretely by the following preferred embodiments.

The description begins with the water-repellent finishing step of the present invention for the ink discharge port periphery, using FIGS. 3A to 3E.

Figure 3A:
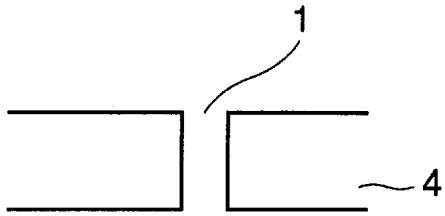
FIGS. 3A, 3B, 3C, 3D and 3E illustrate the steps for producing the ink jet recording head of the present invention.
Figure 3B:
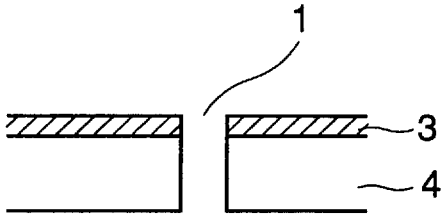

Referring to FIG. 3A, an ink jet head (member that forms the discharge port) 4 is provided with an ink discharge port 1. The ink jet head 4 (ink discharge port face) is coated with a photosensitive resin material having water repellency, to form the water-repellent processing layer 3 (FIG. 3B). In this case, the photosensitive resin material is applied by flexography to skirt around the discharge port portion. However, it can be applied by the normal method in a state that the discharge port is not formed.

Figure 3C:
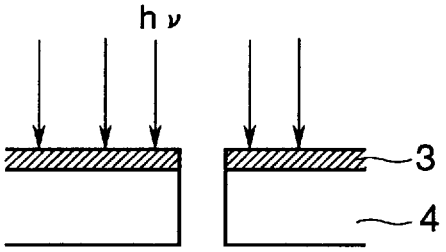
Figure 3D:
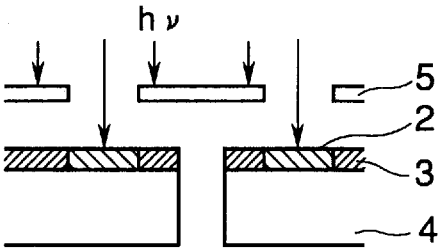

Next, the water-repellent processing layer 3 is irradiated with active energy ray to be cured (FIG. 3C). The ray can be directed to the entire surface or only to the water-repellent processing layer 3. Next, a photomask 5 having a predetermined-shape pattern by which active energy ray does not pass through water-repellent forming region 3 is set. Active energy ray is irradiated in a direction of the arrow shown in FIG. 3D to expose a hydrophilic forming region 2. When the surface of the water-repellent processing layer is irradiated with light in a quantity in excess of the level required to cure the layer, the region loses water repellency and is made hydrophilic. It is preferable to irradiate the water-repellent processing layer with light until the hydrophilic forming region has an angle of contact of 50% or less from the initial level of the water-repellent forming region, in order to secure a sufficient contrast between these regions.

The developing process is made according to the normal method, when the discharge port is not formed. For example, the unexposed, unpolymerized section is eluted out by the aid of solvent or the like, to form the opening corresponding to the discharge port in the water-repellent processing layer. In this case, the discharge port can be formed simultaneously during the development step by use of a discharge port plate of a photosensitive resin material with a latent image previously formed on the discharge port forming portions of the discharge port plate. It is also possible to simultaneously form the opening corresponding to the discharge port and discharge port on the water-repellent processing layer by dry etching or laser beam machining.

Figure 3E:
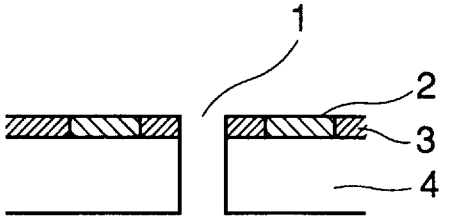

Thus, the ink jet head of the present invention, with the ink discharge port face finished so as to be water-repellent, is obtained (FIG. 3E).

The above hydrophilic treatment can be easily effected by means of a light-irradiating device, which is the same as a conventional device used for curing a water repellent processing agent. It is possible to continuously form the water-repellent and hydrophilic sections by merely replacing the photomask without a changeover of setup.

The discharge port face or water-repellent processing layer is not partly removed in the present invention, forming no irregularities on the discharge port face. The discharge port face can be kept smooth, to greatly prevent waste from accumulating on the hydrophilic section, and hence greatly reduce possibility of unsatisfactory wiping during the discharge port face cleaning step.

Immersion of the discharge port face in the developing solution is no longer required, when the water-repellent processing layer is formed by flexography or the like to skirt around the discharge port beforehand, or the opening corresponding to the discharge port in the water-repellent processing layer is treated simultaneously with the discharge port by laser beam machining or dry etching. Even when a part of the water-repellent processing layer is insufficiently cured, because of insufficient exposure and the water-repellent component in that section is effectively prevented from being eluted in the developing solution, and hence a drop caused by the developing solution, of the water-repellent processing layer is efficiently prevented.

The water-repellent, photosensitive resin materials used for the present invention are those containing a fluorine atom. These resins containing such fluorine atoms include fluorinated epoxy resin, fluorinated polyimide resin, fluorinated polyamide resin, fluorinated acrylic resin, fluorinated polyurethane resin and fluorinated siloxane resin, and a modified resin thereof.

These resins containing a fluorine atom include, but are not limited to, a preferred fluorinated epoxy resin shown by the formula (1):

(1)

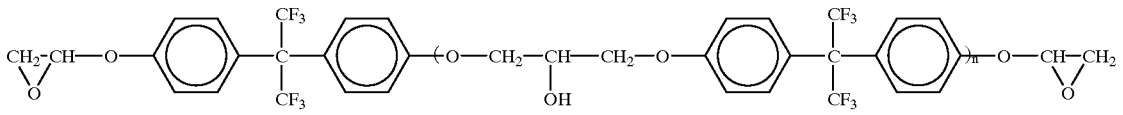

a preferred fluorinated polyimide resin shown by the formula (2):

(2)

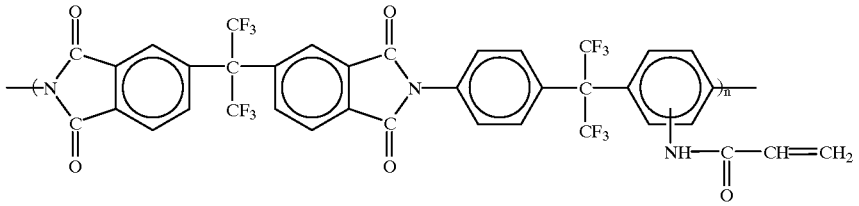

a preferred fluorinated acrylic resin shown by the formula (3): and (3)

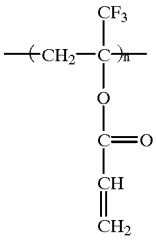

a preferred fluorinated siloxane resin shown by the formula (4):

(4)

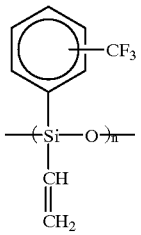

The above fluorine-containing resin may be incorporated with a photopolymerization initiator to be light-sensitive, and may be used as the photosensitive resin material for the present invention.

When the resin material by itself is not sufficiently sensitive to exposure wavelengths, it is optionally incorporated with a sensitizer at a content conventionally used, in order to improve its sensitivity. Such a sensitizer includes, but is not limited to, an azide-based initiator, e.g., 4,4'-diazidediphenylmethane and 4,4'-diazidediphenylsulfide; an acetophenone-based initiator, e.g., α,α-dimethoxy-α-phenylacetophenone; a cationic initiator, e.g., triphenylsulfonium salt; a bis-azide-based sensitizer, e.g., 2,6-bis(4'-azidebenzal)methylcyclohexanone and 2,6-bis(4'-azidebenzylidine)-t-butylcyclohexanone; and a triazine-based sensitizer, e.g., 1-naphthyl-bis-trichloromethyl-2-triazine and 1-(4-methoxyanthracenyl)-bis-trichloro-2-triazine. The above sensitizer may be incorporated with another sensitizer, e.g., perylene, anthracene, phenothiazine, 5-nitroacenaphthene, N-acetyl-4-nitro-1-naphthylamine, Michler's ketone, 9-fluorenone, p-nitroaniline, benzyl, 1,2-benzanthracene, pyrene, p-quinone, 4-nitro-1-naphthylamine and erythrosine.

In order to enhance adhesiveness of the photosensitive resin material, the resin (e.g., epoxy resin, polyimide resin, polyamide resin, acrylic resin, siloxane resin or polyurethane resin, or a modified resin thereof), which serves as the main body of the above fluorine-containing resin, may be mixed with a photosensitive resin material. It may be also optionally mixed with a flexibility adjuster, silicone resin or silicone-modified resin, in order to enhance flexibility of resin.

It is effective to use an initiator of cationic polymerization as an initiator of the polymerization, when an epoxy resin is used as the main body of the fluorine-containing resin, because the chemical compound of the cationic polymerization of the epoxy resin is further cured under heating, after being cured with light, to be highly resistant to ink.

EXAMPLE

The present invention is described in detail by the following example using the figures, which by no means limit the invention.

EXAMPLE 1

A photosensitive water repellent agent, having the following composition, was printed by flexography on the discharge port periphery in the head, which is equipped with a plurality of the discharge ports, provided over the entire width of the recording area in the recording medium, to discharge an ink by means of an electrothermal energy converter generating thermal energy by its liquid-discharging energy generating section.

(Composition of the Photosensitive Water Repellent Agent)

Bis-phenol A type epoxy resin: 44 parts
(Nagase Chiba, Araldite CY-179)

Silicon-modified epoxy resin: 10 parts
(The Shin-Etsu Chemical Co., Ltd., Epoxysiloxane LS7970)

Fluorinated epoxy resin: 46 parts
(Mitsubishi Materials Corporation, Epoxy having perfluoro group at the terminals, MF-120)

Silane coupling agent: 5 parts
(Nippon Unicar, A-187)

Photopolymerization initiator: 5 parts
(Asahi Denka, Cationic photopolymerization initiator, SP-170)

Figure 1:
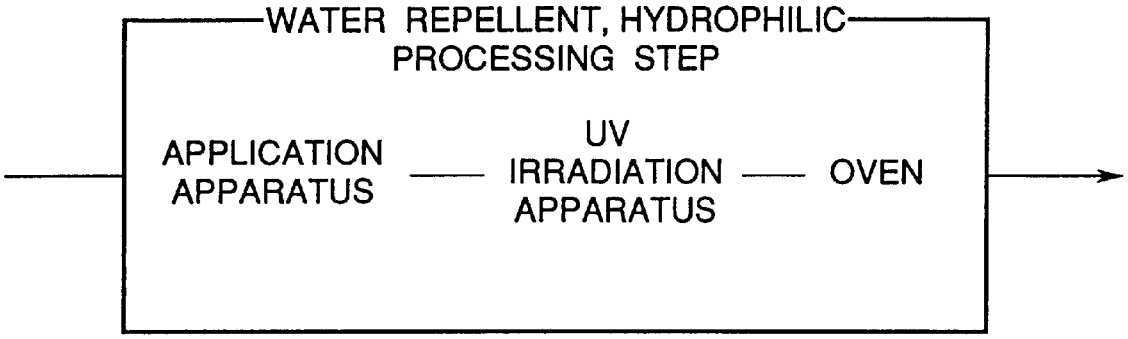
FIG. 1 shows a flow scheme of the water-repellent and hydrophilic finishing steps as one of the preferred embodiments of the present invention.
Figure 2:
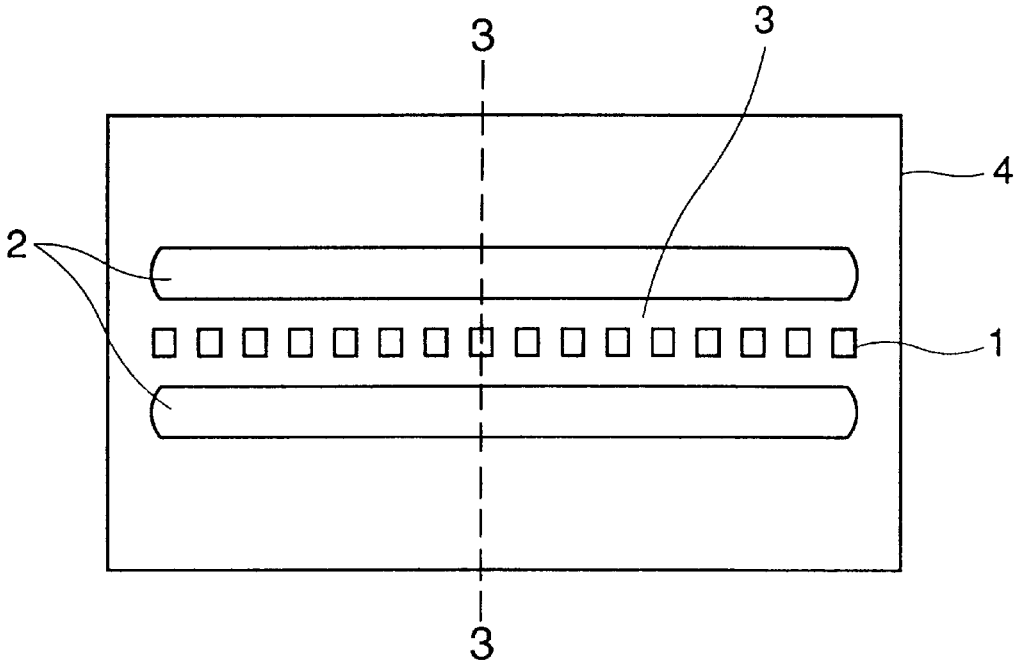
FIG. 2 is a schematic cross-sectional view illustrating the ink discharge port periphery of the ink jet recording head produced by the method of the present embodiments.

Irradiation with ultraviolet ray was then made at 51.2 $mW/cm^2$ for 162 seconds using a light-irradiating device of Oak Seisakusho, HMW-348-2 as a UV-irradiating device to form the water-repellent coating film. Subsequently irradiation with ultraviolet rays was made at the same luminous flux density for 5 minutes onto the hydrophilic section around the ink discharge port, to form the hydrophilic section. Finally, curing under heating was made at 130° C. for 1 hour, to form the partly hydrophilic water-repellent coating film having a portion of hydrophilicity, and thereby to form the ink jet recording head (FIG. 1).

The test piece made by curing and processing the photosensitive water repellent agent, according to the procedures described in EXAMPLE 1, was analyzed to determine its angles of contact with respect to an ink (Canon Inc., BJC-600) at the hydrophilic and water-repellent sections, using a contact angle meter (Kyowa Kaimen Kagaku, CA-D).

The good results were observed, because the angle of contact was 70° at the water-repellent section and 28° at the hydrophilic section. No irregularity was observed between the water-repellent and hydrophilic sections.

The ink jet recording head, prepared by EXAMPLE 1, was used to print letters after it was set in an ink jet recording apparatus. The printing quality was satisfactory, because no defective or deformed dot was observed.

The present invention provides a method for easily producing an ink jet recording head of high ink discharge stability by an inexpensive production apparatus, and also provides an ink jet recording head produced by the above method.

What is claimed is:

1. A method for producing an ink jet recording head, equipped with an ink discharge port from which ink is discharged, and ink discharge port face which is a flat surface and on which the ink discharge port is arranged and a discharge energy generating element which generates energy for discharging the ink, and provided with a water-repellent processing layer having a partially hydrophilic portion in proximity to a water-repellent region around the ink discharge port in the ink discharge port face, comprising the following steps:

forming a photosensitive water-repellent processing layer on the ink discharge port face, irradiating light onto a water-repellent forming region and a hydrophilic forming region in said water-repellent processing layer, to cure said layer, irradiating light only onto said hydrophilic forming region to reduce water repellancy of said water-repellent processing layer and to impart hydrophilicity to said hydrophilic forming region while maintaining the flat surface state of the discharge port face, and forming an opening, which constitutes a part of said ink discharge port, in said water-repellent processing layer by development.

2. A method for producing an ink jet recording head according to claim 1, wherein an angle of contact of said hydrophilic forming region is 40% or lower of an angle of contact of said water-repellent forming region.

3. A method for producing an ink jet recording head according to claim 1, wherein said photosensitive water-repellent processing layer contains a resin containing a fluorine atom.

4. A method for producing an ink jet recording head according to claim 3, wherein said resin containing the fluorine atom is selected from the group consisting of fluorinated epoxy resin, fluorinated polyimide resin, fluorinated polyamide resin, fluorinated acrylic resin, fluorinated polyurethane resin and fluorinated siloxane resin, and a modified resin thereof.

5. A method for producing an ink jet recording head according to claim 1, wherein said photosensitive water-repellent processing layer contains a cationic polymerization initiator.

6. A method for producing an ink jet recording head according to claim 1, wherein said liquid-discharging energy generating portion is an electrothermal converter which generates thermal energy.

7. A method for producing an ink jet recording head, equipped with an ink discharge port from which ink is discharged, an ink discharge port face which is a flat surface and on which the ink discharge port is arranged and a discharge energy generating element which generates energy for discharging the ink, and provided with a water repellant processing layer having a partially hydrophilic portion in proximity to a water-repellant region around the ink discharge port in the ink discharge port face, comprising the following steps:

forming a photosensitive water-repellent processing layer on the ink discharge port face, irradiating light onto a water-repellent forming region in said water-repellent processing layer, to cure said water-repellent layer, irradiating light in a quantity in excess of the level required for curing said water-repellent processing layer onto a hydrophilic forming region to reduce water repellancy of said water-repellent processing layer and to impart hydrophilicity to said hydrophilic forming region while maintaining the flat surface state of the discharge port face, and forming an opening, which constitutes a part of said ink discharge port, in said water-repellent processing layer by development.

8. A method for producing an ink jet recording head according to claim 7, wherein angle of contact of said hydrophilic forming region is 40% or lower of an angle of contact of said water-repellent forming region.

9. A method for producing an ink jet recording head according to claim 7, wherein said photosensitive water-repellent processing layer contains a resin containing a fluorine atom.

10. A method for producing an ink jet recording head according to claim 9, wherein said resin containing the fluorine atom is selected from the group consisting of fluorinated epoxy, resin, fluorinated polyimide resin, fluorinated polyamide resin, fluorinated acrylic resin, fluorinated polyurethane resin and fluorinated siloxane resin, and a modified resin thereof.

11. A method for producing an ink jet recording head according to claim 7, wherein said photosensitive water-repellent processing layer contains a cationic polymerization initiator.

12. A method for producing an ink jet recording head according to claim 7, wherein said liquid-discharge energy generating portion is an electrothermal converting member which generates thermal energy.

* * * * *

UNITED STATES PATENT AND TRADEMARK OFFICE

CERTIFICATE OF CORRECTION

PATENT NO. : 6,484,399 B2
DATED : November 26, 2002
INVENTOR(S) : Kenji Aono et al.

It is certified that error appears in the above-identified patent and that said Letters Patent is hereby corrected as shown below:

Column 6,
Line 8, “water repellent” should read -- water-repellent --;
Line 16, “Water Repellent” should read -- Water-Repellent --; and
Line 65, “discharged, and” should read -- discharged, an --.

Column 8,
Line 1, “water” should read -- water- --;
Line 2, “repellant” should read -- repellent --;
Line 3, “water-repellant” should read -- water-repellent --;
Line 23, “wherein angle of contact” should read -- wherein an angle of contact --; and
Line 33, “epoxy, resin” should read -- epoxy resin --.

Signed and Sealed this

Second Day of September, 2003

JAMES E. ROGAN
*Director of the United States Patent and Trademark Office*